US010264351B2

(12) United States Patent
Choisel et al.

(10) Patent No.: US 10,264,351 B2
(45) Date of Patent: Apr. 16, 2019

(54) LOUDSPEAKER ORIENTATION SYSTEMS

(71) Applicant: Apple Inc., Cupertino, CA (US)

(72) Inventors: Sylvain J. Choisel, Palo Alto, CA (US); Adam E. Kriegel, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/613,040

(22) Filed: Jun. 2, 2017

(65) Prior Publication Data

US 2018/0352324 A1 Dec. 6, 2018

(51) Int. Cl.

| | |
|---|---|
| ***H04R 1/02*** | (2006.01) |
| ***H04R 1/40*** | (2006.01) |
| ***H04R 3/00*** | (2006.01) |
| ***H04R 3/12*** | (2006.01) |

(52) U.S. Cl.

CPC ..... *H04R 1/403* (2013.01); *H04R 1/02* (2013.01); *H04R 1/406* (2013.01); *H04R 3/005* (2013.01); *H04R 3/12* (2013.01); *H04R 2201/403* (2013.01)

(58) Field of Classification Search

CPC ..... H04R 1/403; H04R 1/02; H04R 1/406; H04R 3/005; H04R 3/12; H04R 2201/403

USPC ..... 381/26, 28, 59, 77, 79, 89, 91, 92, 95, 381/96, 97, 308, 333, 336

See application file for complete search history.

(56) References Cited

U.S. PATENT DOCUMENTS 5,561,737 A * 10/1996 Bowen ..... H04M 3/56 379/206.01

2003/0051532 A1 3/2003 Beaucoup et al.
2004/0175006 A1 9/2004 Kim et al.

(Continued)

FOREIGN PATENT DOCUMENTS

WO WO 2011144499 A1 * 11/2011 ..... H04R 1/403

OTHER PUBLICATIONS

Mihailo Kolundzija, Christof Faller, and Martin Vetterli, Baffled Circular Loudspeaker Arraywith Broadband High Directivity, 2010, IEEE, ICASSP2010, pp. 73-76.*

(Continued)

*Primary Examiner* — Paul Kim
*Assistant Examiner* — Friedrich W Fahnert
(74) *Attorney, Agent, or Firm* — Ganz Pollard, LLC

(57) ABSTRACT

An audio system embodiment includes a loudspeaker cabinet having at least one loudspeaker transducer and defining a longitudinal axis. Several microphones are distributed around the longitudinal axis, defining an array of microphones. A reference microphone is positioned in the loudspeaker cabinet, e.g., in a rear chamber of the at least one loudspeaker transducer. The audio system includes a processor and a memory having instructions that, when executed by the processor, cause the audio system to receive an audio signal from each distributed microphone and the reference microphone, and therefrom to estimate a direction, relative to the plurality of microphones, of a nearby, acoustically reflective surface. Responsive to the estimated direction, the audio system affects a mode of operation, e.g., beam forms an audio output in a selected direction corresponding to the estimated direction of the acoustically reflective surface. Related principles are described by way of reference to exemplary embodiments.

27 Claims, 5 Drawing Sheets

(56) References Cited

U.S. PATENT DOCUMENTS

| | | | | |
|---|---|---|---|---|
| 2004/0240697 | A1* | 12/2004 | Keele, Jr. | H04R 1/403 381/336 |
| 2006/0269080 | A1* | 11/2006 | Oxford | H04M 1/6008 381/92 |
| 2009/0322559 | A1 | 12/2009 | Yen et al. | |
| 2011/0129105 | A1 | 6/2011 | Choi et al. | |
| 2015/0078594 | A1* | 3/2015 | McGrath | H04S 7/30 381/300 |
| 2017/0295429 | A1* | 10/2017 | Poletti | H04R 5/027 |

OTHER PUBLICATIONS

Lu, Jerry, "Can You Hear Me Now," Medium, Aug. 1, 2017, 12 pages, available from https://towardsdatascience.com/can-you-hear-me-now-far-field-voice-475298ae1fd3, last accessed on Nov. 9, 2018.

* cited by examiner

LOUDSPEAKER ORIENTATION SYSTEMS

BACKGROUND

This application, and the innovations and related subject matter disclosed herein, (collectively referred to as the "disclosure") generally concern systems for inferring a relative orientation of an apparatus from observations of an acoustic signal. More particularly but not exclusively, some disclosed principles are embodied as an audio device configured to detect a nearby, acoustically reflective surface, such as, for example, a nearby wall, book case, or shelf, from observed impulse responses to emissions from the audio device. The inferred orientation information can be used to affect a mode of operation of the device. For example, the orientation can be input to an acoustic beam former or other audio renderer to tailor the acoustic device's output to an in situ listening environment. Other examples include, but are not limited to, tailoring a video projector's projection direction relative to the inferred orientation, communicating orientation information over a communication connection, and issuing an alert in a user- or machine-readable form.

Known media systems, such as, for example, televisions, video projectors, loudspeaker cabinets, and sound processors require some degree of manual input or adjustment to establish, for example, a desired sound field corresponding to the media systems's environment. An audio processor can cause a given media system (or loudspeaker transducer therein) to emit a tone during a user-initiated calibration (e.g., during initial setup or after moving the media system). A microphone transducer can provide to an audio processor an observed frequency response to the emitted tone. The observed frequency response generally corresponds to the system through which the emitted tone passes. Based on the observed frequency response, the sound processor can alter, or adjust or otherwise "tune," an acoustic signal provided to the loudspeaker in an attempt to render audio playback in a desired fashion.

However, conventional approaches to pursuing a desired sound field suffer several deficiencies. For example, many users dislike manually tuning their audio systems. As well, many users lack a separate microphone suitable for providing a frequency response to an audio processor. And, loudspeaker response characteristics tend to drift over time and in response to changes in temperature, requiring further manual tuning to correct. Still further, a change in a tuned loudspeaker's position can change the response characteristics and require a revised tuning, or calibration, of the audio renderer to achieve a desired response or sound field. Further, using an artificial tone to tune a loudspeaker interrupts a user's enjoyment of the loudspeaker because it prevents playing desired audio media during tuning procedures.

Thus, a need exists for an audio system to automatically infer its position and/or orientation in relation to its environment. A need also exists for an audio system to assess its tuning from time to time to account for changes in loudspeaker output characteristic and/or position. A need also exists for an audio system to assess or to change its tuning during playback of desired acoustic signals (e.g., during media playback, also sometimes referred to as "nominal playback") to reduce or minimize disruption to a user's listening experience.

SUMMARY

The innovations disclosed herein overcome many problems in the prior art and address one or more of the aforementioned or other needs. In some respects, the innovations disclosed herein generally concern systems and associated techniques for estimating an orientation of an audio device relative to a nearby, acoustically reflective surface. Such an audio device can, in response to the estimate, affect a mode of operation for the audio device, such as, for example, by rendering a desired sound field in a direction away from the surface, by projecting a visual display toward the surface, by transmitting information regarding the orientation over a communication connection, and/or by issuing an alert or other user- or machine-readable information regarding an operational status of the device.

For sake of brevity, disclosed principles largely are described in relation to affecting a sound field. However, it shall be understood that rendering a sound field is but one specific mode of operation sensitive to orientation of a nearby surface. Therefore, this disclosure is not limited to affecting only sound-field characteristics. Rather, this disclosure encompasses affecting any mode of operation of an electronic or other device sensitive to a position or orientation of a surface relative to the electronic device. Examples of such modes include, but are not limited to, projecting an image or video on the surface, informing operation of another device or set of devices, communicating orientation information to another device over a communication connection.

As but one example, an audio or other system can have several microphone transducers as well as a reference microphone transducer. Further, the system can have at least one loudspeaker transducer to emit a sound field. The system can also include a processor and a memory containing instructions that, when executed by the processor, cause the system to receive a corresponding audio signal for each respective microphone transducer, and to estimate a direction, relative to the plurality of microphones, of an acoustically reflective surface. The system can affect a mode of operation of the system based at least in part of the estimated direction.

For example, the at least one loudspeaker transducer can be a plurality of loudspeaker transducers constituting a portion of an acoustic beam former. The mode of operation can be rendering of a sound field, and the system can render the sound field in a direction relative to (e.g., away from) the estimated direction.

The estimate can be based in part on each received audio signal.

The system can also have a reference microphone transducer and an enclosure for the at least one loudspeaker transducer. The enclosure can define a rear chamber for the at least one loudspeaker transducer, and the reference microphone transducer can be positioned in the rear chamber. The instructions, when executed by the processor, can further cause the reference microphone transducer to receive a reference audio signal and to cause the audio system to further estimate the direction based in part on the reference audio signal. For example, the instructions can cause the audio system to estimate a magnitude of a transfer function between each respective one of the spatially distributed microphones and the reference microphone transducer. From the plurality of magnitudes, the system can estimate the direction.

The instructions can further cause the audio system to estimate the direction from a phase of the first-order mode of a Fourier decomposition of a sequence of the transfer-function magnitudes, from a determined variation of the transfer-function magnitudes with microphone position relative to the loudspeaker cabinet, or from both.

The loudspeaker cabinet can define a longitudinal axis. The plurality of microphones can be distributed (e.g., evenly) around the longitudinal axis to define a microphone beam former. The plurality of loudspeaker transducers can be distributed (e.g., evenly) around the longitudinal axis to define a loudspeaker beam former.

An audio output by the system can include a media playback. The system can estimate the direction concurrently with the output of the media playback. Further, the system can beam form the media playback in a direction opposite the estimated direction and/or otherwise affect a mode of operation of the device operation concurrently with the emission of the media playback.

Also disclosed are associated methods, as well as tangible, non-transitory computer-readable media including computer executable instructions that, when executed, cause a computing environment to implement one or more methods disclosed herein. Digital signal processors embodied in software, firmware, or hardware are suitable for implementing such instructions are also disclosed.

The foregoing and other features and advantages will become more apparent from the following detailed description, which proceeds with reference to the accompanying drawings.

BRIEF DESCRIPTION OF THE DRAWINGS

Unless specified otherwise, the accompanying drawings illustrate aspects of the innovations described herein. Referring to the drawings, wherein like numerals refer to like parts throughout the several views and this specification, several embodiments of presently disclosed principles are illustrated by way of example, and not by way of limitation.

DETAILED DESCRIPTION

The following describes various innovative principles related to systems for inferring a relative orientation of an apparatus from observations of incident acoustic signals by way of reference to specific embodiments. For example, certain aspects of disclosed principles pertain to systems for assessing an audio device's orientation relative to a nearby wall or other acoustically reflective surface or boundary. Embodiments of such systems described in context of specific apparatus configurations and combinations of method acts are but particular examples of contemplated systems chosen as being convenient illustrative examples of disclosed principles. One or more of the disclosed principles can be incorporated in various other systems to achieve any of a variety of corresponding system characteristics.

Thus, systems having attributes that are different from those specific examples discussed herein can embody one or more presently disclosed innovative principles, and can be used in applications not described herein in detail. Accordingly, such alternative embodiments also fall within the scope of this disclosure.

I. Overview

Figure 1:
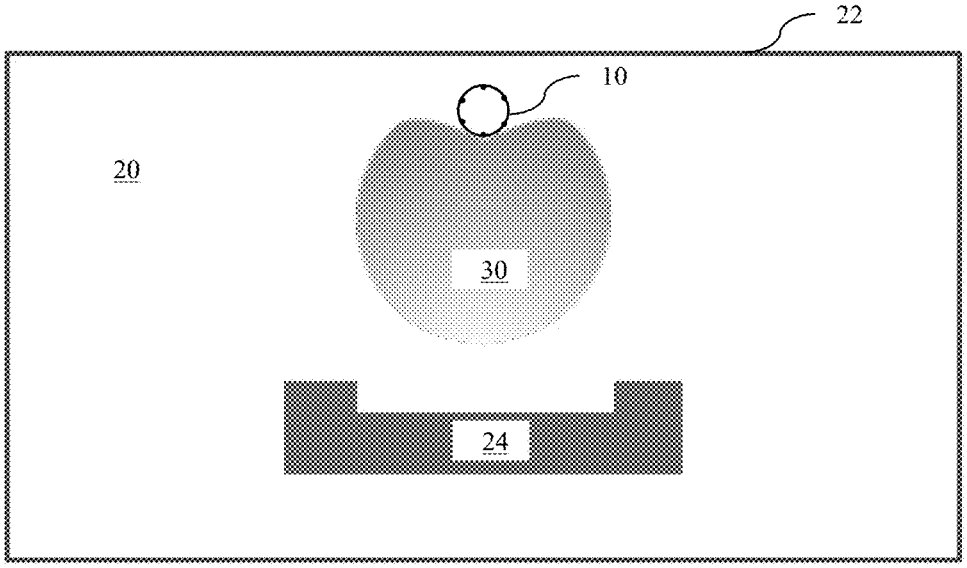
FIG. 1 illustrates a desired sound field in a representative listening environment.

Referring now to FIG. 1, a loudspeaker cabinet 10 can be positioned in a room 20. A desired sound-field 30 from the loudspeaker cabinet can correspond to a position of one or more reflective boundaries, e.g., a wall 22, relative to the loudspeaker cabinet 10, as well as a listener's likely position 24 relative to the loudspeaker cabinet.

Innovative principles disclosed herein can be implemented, by way of example, in a manner to automatically infer an orientation of the loudspeaker cabinet 10 relative to the wall 22 (or other nearby acoustically reflective boundary, such as, for example, a shelf or a bookcase divider). The inferred orientation information can be used, by way of example, as an input to an acoustic beam former or other audio renderer to tailor the audio device's output to its in situ listening environment.

In other embodiments, the orientation information can be used to affect one or more other modes of device operation. For example, the device can include an image or a video projector, and an orientation of a projected image or video can be adjusted in correspondence with the orientation information. As another example, the orientation information can inform a mapping function, or can be transmitted to another device over a communication connection. As yet another example, the device can issue an alert or can affect another mode of operation responsive to the orientation information exceeding or falling below a selected threshold orientation.

Figure 2:
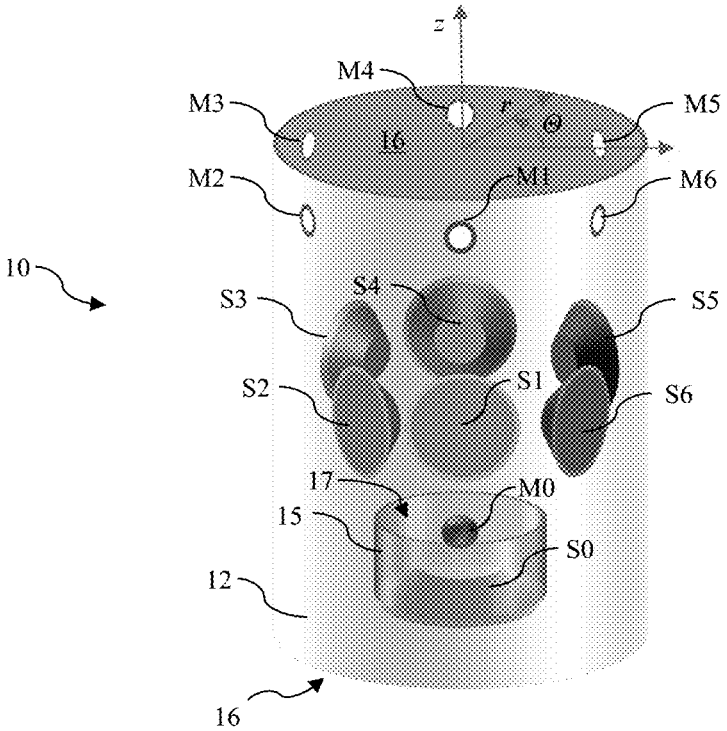
FIG. 2 illustrates an embodiment of an audio device.
Figure 3:
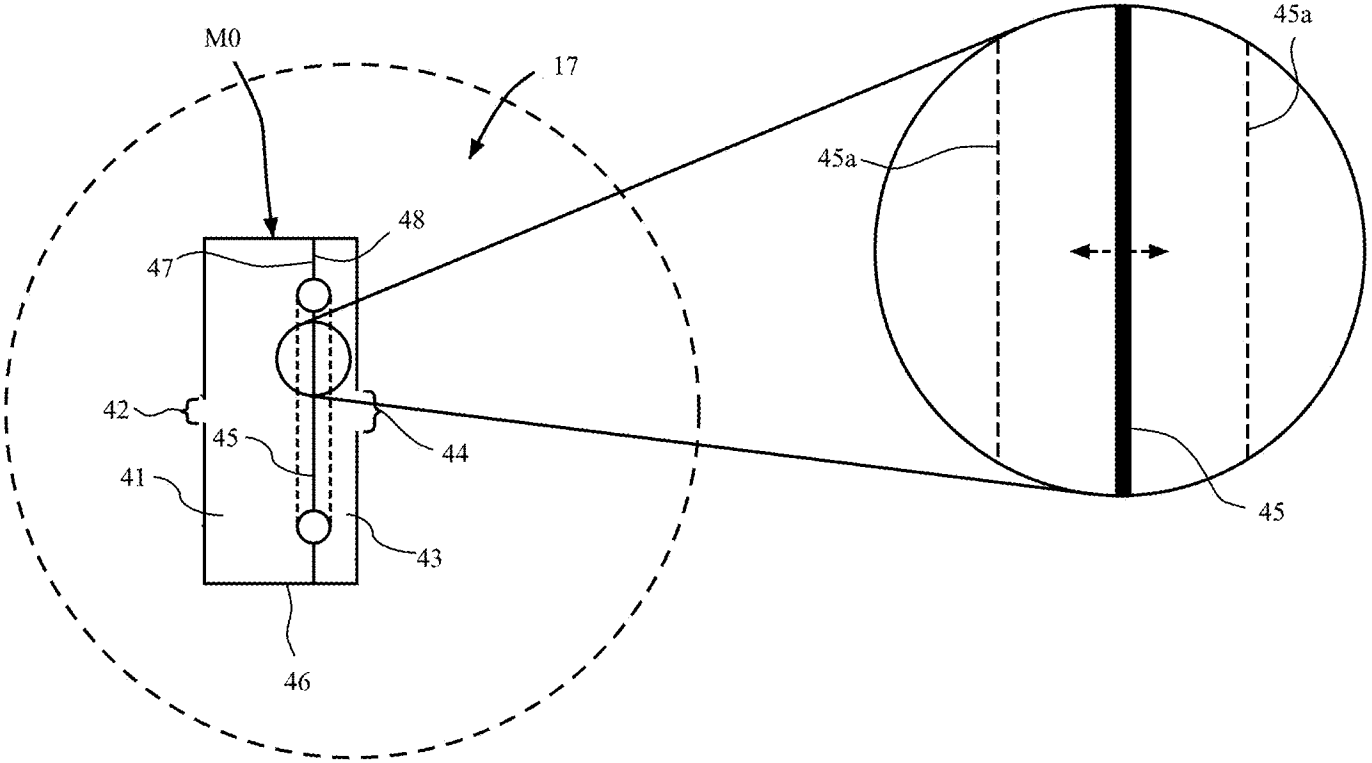
FIG. 3 shows aspects of a disclosed differential-pressure microphone.

Section II describes principles related to disclosed systems by way of reference to the audio device depicted in FIG. 2. Section III describes principles related to estimating orientation of the audio device from observed acoustic signals, and Section IV describes principles related to audio processors suitable to estimate the orientation and/or to render audio to provide a desired sound field in a given listening environment and/or to affect another mode of operation. Section V describes principles related to computing environments suitable for implementing disclosed processing methods.

Other, related principles also are disclosed. For example, the following describes machine-readable media containing instructions that, when executed, cause a processor of, e.g., a computing environment, to perform one or more disclosed methods. Such instructions can be embedded in software, firmware, or hardware. In addition, disclosed methods and techniques can be carried out in a variety of forms of signal processor, again, in software, firmware, or hardware.

II. Audio Devices

FIG. 2 shows an audio device 10 that includes a loudspeaker cabinet 12 having integrated therein a loudspeaker array including a plurality of individual loudspeaker transducers $S_1, S_2, \ldots, S_6$ and a microphone array including a plurality of individual microphones $M_1, M_2, \ldots, M_6$. Each of the microphones $M_1, M_2, \ldots, M_6$ in the microphone array is arranged to measure an acoustic pressure externally of the audio device 10.

In general, a loudspeaker array can have any number of individual loudspeaker transducers, despite that the illustrated array has six loudspeaker transducers. Likewise, a microphone array can have any number of individual microphone transducers, despite that the illustrated microphone array has six microphones. The number of loudspeaker transducers and microphones depicted in FIG. 2 is selected for convenience of illustration. As well, some audio devices have a same number of loudspeaker transducers and microphone transducers, as with the embodiment shown in FIG. 2. Nonetheless, other audio devices have more microphone transducers than loudspeaker transducers, or vice-versa.

In FIG. 2, the cabinet 12 has a generally cylindrical shape defining a central, longitudinal axis z arranged perpendicularly to the opposed ends 16 of the cylindrical cabinet. The microphones $M_1, M_2, \ldots, M_6$ in the microphone array are distributed evenly around the central, longitudinal axis at a constant, or a substantially constant, radial distance from the axis. The microphones $M_1, M_2, \ldots, M_6$ in the microphone array are circumferentially spaced apart from each other. In the illustrated embodiment, each of the microphones $M_1, M_2, \ldots, M_6$ is circumferentially spaced from each immediately adjacent microphone by 60 degrees. Of course, other embodiments can space the microphones more or less (e.g., in correspondence to the number of microphones in the array being less or more than six). As well, some microphone arrays do not have equally spaced apart microphone transducers, such that some microphones are relatively closer together than other microphones.

In still other embodiments, the arrangement and number of microphones can vary. For instance, instead of the microphone array extending around a circumference of the cabinet 10, microphones in another microphone array can be aligned in one or more rows, as in the style of a sound bar.

Each of the loudspeaker transducers $S_1, S_2, \ldots, S_6$ in the loudspeaker array may be arranged side-by-side and circumferentially distributed around the central longitudinal axis of the cabinet 10. Other arrangements for the loudspeaker transducers are possible. For instance, the loudspeaker transducers in the array may be distributed evenly (e.g., around the longitudinal axis separated from adjacent microphones by a constant angle, $\Theta$, or at least one loudspeaker transducer for each outward surface of a cabinet shaped as a rectangular prism) within the loudspeaker cabinet 10, or unevenly. As well, the loudspeaker transducers $S_1, S_2, \ldots, S_6$ can be positioned at various selected longitudinal positions, rather than at one longitudinal position as shown in FIG. 2. Each transducer $S_0, S_1, \ldots, S_6$ may be an electrodynamic or other type of driver that may be specially designed for sound output at particular frequency bands, such as a subwoofer, tweeter, or midrange driver, for example. In some embodiments, the audio device 10 has but one individual loudspeaker transducer.

Also shown in FIG. 2 is an enclosure, or housing, 15 defining an enclosed rear chamber 17 for a loudspeaker transducer $S_0$. Mounted within the rear chamber 17 is an internal microphone, sometimes referred to as a "reference microphone," $M_0$. In general, the internal microphone $M_0$ can be configured as any type of microphone suitable for operating in an enclosed chamber of the loudspeaker transducer $S_0$. In some instances, however, a conventional, e.g., unidirectional, microphone may have an insufficient range to accommodate large changes in pressure arising from large and/or rapid excursions of a diaphragm or other air mover of the loudspeaker transducer $S_0$. Consequently, such a conventional microphone can "clip" or simply not respond over the full range of excursion.

In some embodiments, a differential-pressure-gradient microphone M0 (FIG. 6) can be used in the rear chamber 17 and can be tuned to be relatively insensitive over a selected range of frequencies over which the loudspeaker transducer $S_0$ operates. For example, a microphone M0 can define a pair of opposed chambers 41, 43 separated from each other by a membrane 45. Each chamber 41, 43 can have a corresponding port 42, 44 open to a local microphone environment (e.g., the rear chamber 17 of the loudspeaker). One or both ports 42, 44 can be defined by an aggregate of discrete apertures extending through an enclosure 46 of the microphone M0. As well, the ports 42, 44 can be differently sized or otherwise differently arranged relative to each other to impose different respective acoustic impedances between each opposed major surface 47, 48 of the membrane 45 and the local environment 17. Thereby, the microphone membrane 45 can respond to a differential in pressure (e.g., a pressure gradient) between the port(s) of one chamber relative to the port(s) of the other chamber, but not to a change in absolute pressure of the local environment 17. As but one example, such a microphone can attenuate at least 10 dB at a selected degree of harmonic distortion relative to a microphone having a single sealed chamber behind a membrane.

With a pressure-differential microphone as just described, large excursions of the loudspeaker's M0 diaphragm (not shown) will not cause the microphone M0 to clip, and yet the microphone can still be used to indirectly measure a volume velocity (or a volumetric flow rate) produced by the moving diaphragm of the transducer $S_0$, a displacement of the moving diaphragm, and/or acceleration of the moving diaphragm, during playback of an audio signal. In some embodiments, a micro-electro-mechanical system (MEMS) microphone can be configured as a differential-pressure-gradient microphone as just described, and used in the rear chamber 17.

Although the loudspeaker cabinet 10 is shown as being cylindrical, other embodiments of a loudspeaker cabinet 10 have another shape. For example, some loudspeaker cabinets can be arranged as, e.g., a triangular, rectangular, pentagonal, or other general prismatic structure, a tetrahedral structure, a spherical structure, an ellipsoidal structure, a toroidal structure, or as any other desired three-dimensional shape.

III. Orientation Estimation

Referring again to FIG. 1, the audio device 10 can be positioned close to a wall 22. In such a situation, as noted above, directing a sound field 30 toward an interior region of the room, e.g., toward a listener's position 24, can be desirable. Alternatively or additionally, affecting another mode of operation of the device 10 also can be desirable.

Figure 4:
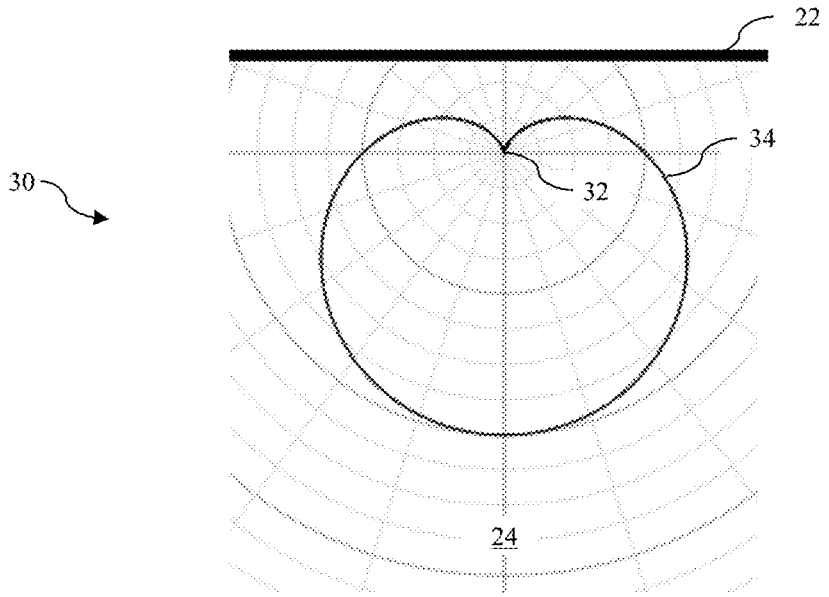
FIG. 4 shows an alternative representation of the desired sound field depicted in FIG. 1.

FIG. 4 depicts the audio device's position shown in FIG. 1 superimposed on a two-dimensional polar coordinate system having an origin 32 coinciding with the longitudinal axis z of the audio device 10 shown in FIG. 2. Notably, the desired sound field 30 is not axisymmetric relative to the axis z, or omni-directional relative to the origin 32. In contrast, the cylindrical cabinet 12 depicted in FIG. 2 is generally axisymmetric, though not formally axisymmetric insofar as the microphones and loudspeaker transducers (and other components) represent discrete, rather than continuous, structures positioned circumferentially around the axis z. In any event, having an orientation of the audio device 10 (or some measure of its orientation) relative to the wall 22, e.g., in a polar coordinate system, can be useful to cause the device 10 to affect a mode of device operation, e.g., to project the sound field 30 away from the wall 22.

The schematic, top-plan views of the audio device shown in FIG. 4 depict a general approach to establish an orientation of the audio device 10 relative to, e.g., the microphone array. As described more fully below, observations of acoustic responses by the microphone array can be used to determine an orientation of the microphone array relative to a nearby acoustically reflective surface. Thus, so long as the position of the microphone array is known relative to the audio device 10, an orientation of the audio device and its constituent features, e.g., the loudspeaker array, also can be determined.

For ease of illustration, the arrows 12*a* and 12*b* point toward a selected microphone $M_1$ in the array. In the orientation 10*a*, the microphone $M_1$ is positioned farthest from the wall 22, and the opposed microphone $M_4$ is positioned closest to the wall. In that orientation, the microphone $M_1$ receives the least acoustic energy, and the microphone $M_4$ receives the most acoustic energy, of the six illustrated microphones (assuming the wall 22 approximates an infinite plane and the audio device 10 emits omnidirectional sound).

In the orientation 10*b*, the audio device has been rotated counter-clockwise by 90 degrees relative to the orientation 10*a*. In the orientation 10*b*, the point of least-incident acoustic energy, on the same assumptions as above, is positioned between microphones $M_2$ and $M_3$, and the point of highest-incident acoustic energy is positioned between microphones $M_5$ and $M_6$.

More generally, a measure of a so-called "radiation impedance" can be determined, or estimated, for each microphone $M_1, M_2, \ldots, M_6$ in the microphone array "looking into the room." For example, the audio device 10 can compute a difference in the frequency response observed by each respective microphone $M_1, M_2, \ldots, M_6$ in the microphone array and the reference microphone $M_0$. As well, a magnitude of each difference in frequency response, each corresponding to a respective one of the microphone positions around the longitudinal axis z, can be computed across a selected frequency band, e.g., between about 20 Hz and about 1 kHz, such as between about 30 Hz and about 500 Hz with between about 100 Hz and about 300 Hz being a particular frequency band. Other frequency bands (e.g., midrange- and high-frequency bands) can also be suitable.

Such difference is referred to herein as a "radiation impedance." The radiation impedance for a given microphone is, in general, affected by properties of the room environment, as well as the position of the audio device 10 within the room (e.g., proximity to walls and some furniture items). In addition, since each external microphone is spatially separated with respect to the others, the calculated radiation impedance associated with each external microphone may be different than the calculated radiation impedance associated with the other microphones.

The plots 40*a*, 40*b* shown in FIG. 4 graphically depict representative magnitudes computed at each microphone $M_1, M_2, \ldots, M_6$ in the microphone array for the orientations 10*a*, 10*b*, respectively. As shown by the plot 40*a*, the magnitude of the radiation impedance is smallest at the microphone $M_1$ and largest at the microphone $M_4$ under the device orientation 10*a*. Similarly, the plot 40*b* depicts a largest radiation impedance between microphones $M_5$ and $M_6$ and a least radiation impedance between microphones $M_2$ and $M_3$ in the orientation 10*b*.

An orientation of the audio device relative to a nearby, acoustically reflective boundary, like a wall or a bookcase, can be estimated using the foregoing information. For example, the position of each microphone $M_1, M_2, \ldots, M_6$ in the microphone array relative to the longitudinal axis z can represent an angular coordinate in the r–Θ plane (FIG. 4).

Figure 5:
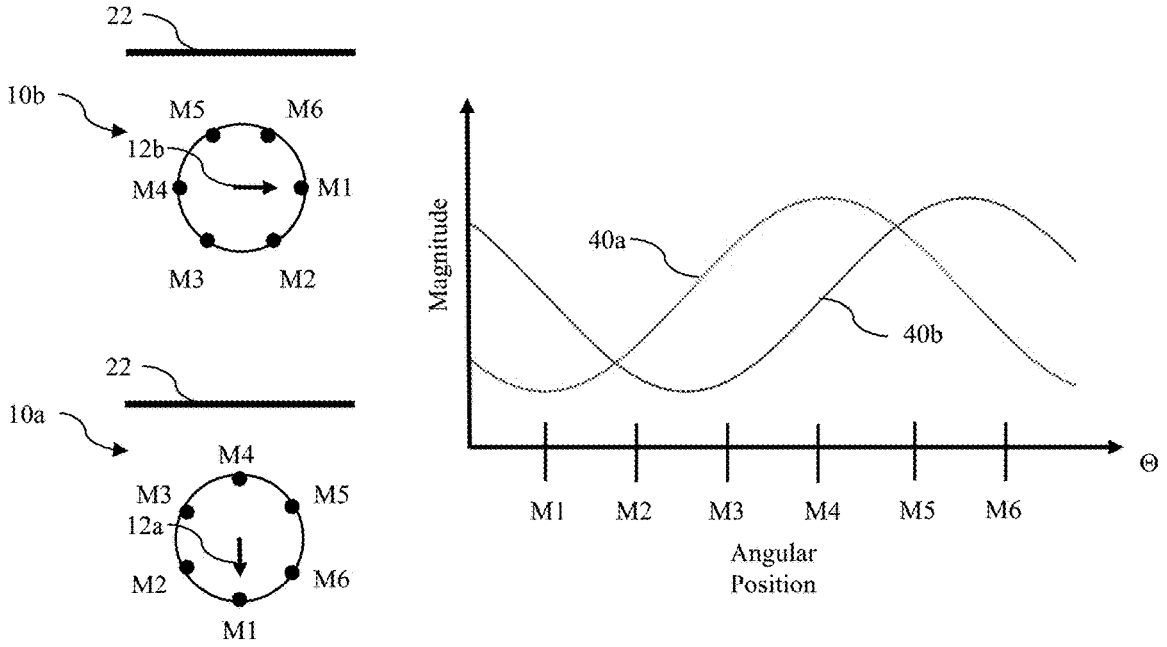
FIG. 5 shows two schematic, plan views from above the audio device depicted in FIG. 2 oriented differently from each other relative to a nearby wall, together with a plot indicative of an amount of acoustic energy received by the audio device.

And, recognizing that for a nearby wall, the magnitude of the radiation impedance reaches a maximum in a direction of the wall, an orientation of the audio device 10 relative to the wall 22 can be ascertained by determining an angular position of the maximum radiation impedance (FIG. 5). With that direction estimate, the audio device 10 can render a sound field in a direction away from, e.g., opposite, the wall, or otherwise affect a mode of operation.

In some instances, the radiation impedance can be relatively flatter than that shown in FIG. 4 over several microphone positions. For example, the audio device 10 can be positioned in a book case having more than one nearby, acoustically reflective surface positioned to partially surround the audio device. With such an environment, directing a sound field in a direction away from the direction of maximum radiation impedance might not yield the best perceived sound field at a listener's position. An alternative approach to determine a direction of the "effective" acoustically reflective boundary can include computing a Fourier decomposition of a sequence of the radiation-impedance magnitudes at each microphone position, and computing a phase of the first-order mode (e.g., the second bin in the complex FFT). That phase can approximate the direction of the "effective" acoustically reflective boundary.

As yet another example, the direction of the acoustically reflective boundary can be estimated by combining the directions determined from the foregoing approaches. For example, a numeric or other average of the determined directions can be computed from the foregoing approaches.

Responsive to the determined direction of the nearby, acoustically reflective surface, the audio device 10 can affect a mode of device operation. For example, the device 10 can render a sound field in a selected direction, e.g., in a direction away from the reflective surface. For example, the audio device 10 shown in FIG. 1 has an array having a plurality of loudspeaker transducers $S_1, S_2, \ldots, S_6$, and the array can constitute a portion of an acoustic beam former, and the plurality of loudspeaker transducers can emit an acoustic beam directed in one or more desired directions relative to the estimated direction of a nearby acoustically reflective surface.

In other embodiments, a processor can render an image or a video in a direction toward the acoustically reflective surface. In some embodiments, the audio device can estimate the radiation impedances for the various microphones and estimate a direction of a nearby acoustically reflective surface during nominal playback of a media content. Moreover, the direction of nearby acoustically reflective surfaces can be estimated by the audio device 10 from time to time, and the mode of operation, e.g., direction of the sound field, can be updated in correspondence with those estimates of direction. Accordingly, a desired direction of the sound field, or other mode of operation, can be determined automatically from time to time without interruption to the user, while still allowing the user to reposition the audio device 10. Such an audio device can avoid inconvenience to a user and improve the overall listening experience to a user.

IV. Audio Processors

Figure 6:
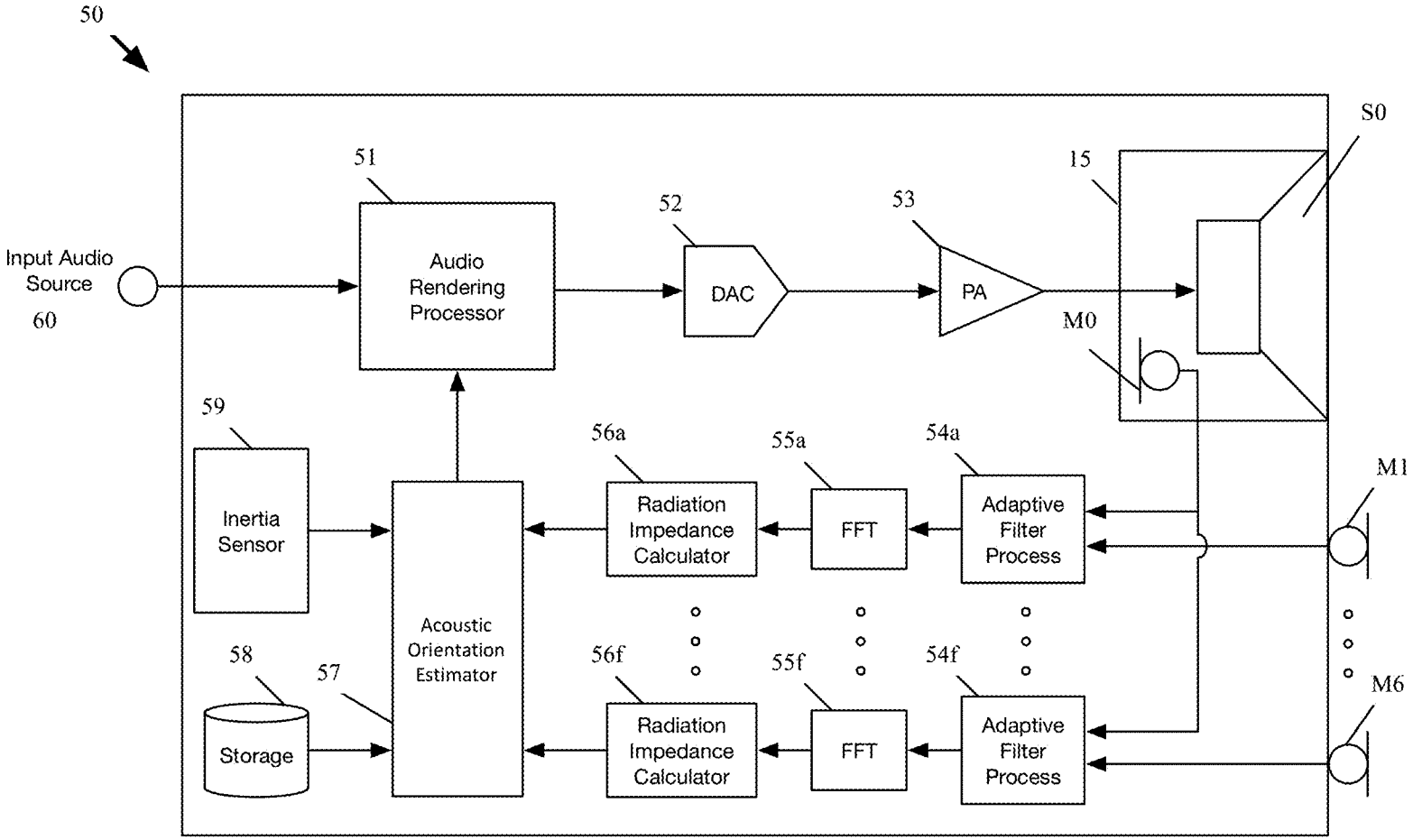
FIG. 6 shows a schematic block diagram of an audio device.

FIG. 6 shows a block diagram of an audio device 50 to playback an audio content (e.g., a musical work, or a movie sound track), similar to the audio device 10. The audio device 50 can include an audio rendering processor 51, a digital-to-analog converter (DAC) 52, a power amplifier (PA) 53, a loudspeaker transducer S0, an internal microphone M0, several external microphones M1, . . . , M6, several adaptive filter process blocks 54*a*, . . . , 54*f*, several transform blocks 55*a*, . . . , 55*f*, several radiation impedance calculators 56*a*, . . . , 56*f*, an acoustic orientation estimator 57, a storage 58, and an (optional) inertia sensor 59. The audio device 50 may be any computing device capable of playing back audio content. For example, the audio device 50 may be a laptop computer, a desktop computer, a tablet computer, a smartphone, a loudspeaker, or a speaker dock. Each feature of the audio device 50 shown in FIG. 6 will now be described.

The audio rendering processor 51 may be a special purpose processor such as an application specific integrated circuit (ASIC), a general-purpose microprocessor, a field-programmable gate array (FPGA), a digital signal controller, or a set of hardware logic structures (e.g., filters, arithmetic logic units, and dedicated state machines). The rendering processor 51 is to receive an input audio channel of a piece of sound program content from an input audio source 60. The input audio source 60 may provide a digital input or an analog input. The input audio source may include a programmed processor that is running a media player application program and may include a decoder that produces the digital audio input to the rendering processor. To do so, the decoder may be capable of decoding an encoded audio signal, which has been encoded using any suitable audio codec, e.g., Advanced Audio Coding (AAC), MPEG Audio Layer II, MPEG Audio Layer III, and Free Lossless Audio Codec (FLAC). Alternatively, the input audio source may include a codec that is converting an analog or optical audio signal, from a line input, for example, into digital form for the audio rendering processor 60. Alternatively, there may be more than one input audio channel, such as a two-channel input, namely left and right channels of a stereophonic recording of a musical work, or there may be more than two input audio channels, such as for example the entire audio soundtrack in 5.1-surround format of a motion picture film or movie. Other audio formats also are contemplated. Other examples are 7.1 and 9.1-surround formats.

The audio rendering processor can receive digital information from the acoustic orientation estimator 57 to indicate a detected change in an acoustic environment, or a detected direction of an acoustically reflective surface in an environment within which the audio device 50 and more specifically the loudspeaker cabinet resides. The audio rendering processor 51 can use this digital information for adjusting the input audio signal in a desired manner. The acoustic orientation estimator 57 and example adjustments that can be made to the audio rendering process performed by the processor 51 are further described below.

The DAC 52 is to receive a digital audio driver signal that is produced by the audio rendering processor 51 and is to convert it into analog form. The PA 53 is to amplify the output from the DAC 52 to drive to the transducer S0. Although the DAC 52 and the PA 53 are shown as separate blocks, in one embodiment the electronic circuit components for these may be combined, not just for each loudspeaker driver but also for multiple loudspeaker drivers (such as part of a loudspeaker array), to provide for a more efficient digital to analog conversion and amplification operation of the individual driver signals, e.g., using for example class D amplifier technologies.

The loudspeaker transducer S0 is in a "sealed" enclosure 225 that creates a back volume around a backside of a diaphragm of the transducer S0. The back volume is the volume inside the enclosure 225.

"Sealed" indicates acoustically sealed in that the back volume does not transfer sound waves produced by the back side of the diaphragm to the outside of the enclosure 225 or to the outside of the loudspeaker cabinet, at the frequencies at which the transducer operates, in order to reduce a possibility of the front sound waves interfering with the back sound waves. There may be a front volume chamber formed around a front side of the diaphragm of the transducer S0 through which the front sound waves exit the loudspeaker cabinet. In one embodiment, the enclosure 225 may have dimensions that are smaller than the wavelengths produced by the transducer. The enclosure 225 may be a smaller volume confined inside the loudspeaker cabinet, or it could be "open" to the full extent of the available internal volume of the loudspeaker cabinet.

An internal microphone M0 may be placed inside the back volume of the enclosure 225. The internal microphone M0 may, in one embodiment, be any type of microphone (e.g., a differential pressure gradient micro-electro-mechanical system (MEMS) microphone) that will be used to indirectly measure volume velocity (volumetric flow rate) produced by the moving diaphragm of the transducer S0, displacement and/or acceleration of the moving diaphragm, during playback of an audio signal. The several external microphones M1, . . . , M6 are each to measure an acoustic pressure, external to the audio device 50. Although illustrated as including only six microphones, in some embodiments, the number of external microphones integrated into audio device 50 may be more or less than six and be arranged in any fashion.

The adaptive filter process blocks 54*a*, . . . , 54*f* are each to receive (1) the same microphone output signal from the internal microphone M0 and (2) a respective microphone output signal from a corresponding external microphone, and based on which they compute estimates of an impulse response of the room. Each adaptive filter process block performs an adaptive filter process to estimate the impulse response of an acoustic system having an input at the transducer and an output at the external microphone that corresponds to (or is associated with) that adaptive filter process block. As each external microphone will sense sound differently despite for example being replicates of each other (e.g., at least due to each being in a different position relative to the transducer S0 and/or relative to a nearby, acoustically reflective surface), the estimated impulse responses will vary among the microphone transducers.

The adaptive filter process can be part of a pre-existing acoustic echo cancellation (AEC) process that may be executing within the audio device 50. For instance, the AEC process can adaptively compute an AEC filter through which a driver signal that is driving the transducer is to pass before being subtracted from the microphone signal that is produced by the external microphone. This may reduce the effects of sounds that are (1) produced by the transducer S0 and (2) captured by the external microphone. This process may use the microphone signal from the internal microphone M0 as a reference signal. The AEC filter can be adaptively adjusted to have an impulse response that is estimated to represent the effect of the room on the sounds being captured by the external microphone. In another embodiment, rather than using the microphone signal from the internal microphone M0 as the reference signal, the audio signal driving the transducer S0 may be used instead, to compute the AEC filter.

The transform blocks 55*a*, . . . , 55*f*, are each to receive an estimated impulse response (e.g., the impulse response of the adaptively computed AEC filter) from their respective adaptive filter process blocks 54*a*, . . . , 54*f*, to apply a fast Fourier transform (FFT) algorithm that converts the impulse response from the time domain to the frequency domain. In other embodiments, other time to frequency domain (sub-band domain) transforms may be used.

Still referring to FIG. 6, the radiation impedance calculators 56*a*, . . . , 56*f*, are each to receive a representation of the estimated impulse response in the frequency domain from their respective transform blocks 55*a*, . . . , 55*f*, to calculate (or rather estimate) a radiation impedance of the transducer S0, "looking into the room" but as viewed from the respective external microphone.

Each of the radiation impedance calculators 56*a*, . . . , 56*f* is to compute a corresponding magnitude of the radiation impedance, or other measure of radiation impedance, representative of the magnitude of the radiation impedance within a selected frequency band. Hence, the radiation impedance calculator 56*a*, . . . , 56*f* can compute a radiation impedance function (e.g., radiation impedance value versus frequency), and derive a measure of radiation impedance from a portion of those values, e.g., from the radiation impedance magnitudes that are within the selected frequency band. For example, the measure can be (1) an average of radiation impedance magnitudes in a certain frequency band or (2) a particular radiation impedance magnitude (e.g., highest, lowest, median) in the certain frequency band. In some embodiments, the radiation impedance calculators 56*a*, . . . , 56*f* filter the calculated radiation impedance values through a bandpass filter that only allows a certain frequency band to pass, to then compute measure. In another embodiment, the measure may be any suitable measure of central tendency (for example, an average or mean) of the radiation impedance values over a certain frequency band.

In some embodiments, evaluating the radiation impedance at a low frequency band (e.g., 100 Hz-300 Hz) allows the audio device 50 to detect large changes within the acoustic environment (e.g., rotating the loudspeaker cabinet so that one of its drivers is directly facing a nearby piece of furniture), while being insensitive to minor changes (e.g., small objects being moved about in a room).

For instance, returning to the example above, the magnitude of the radiation impedance corresponding to the microphone M1 in a low frequency band may be higher than a magnitude of the radiation impedance (in the same frequency band) corresponding to a different microphone, e.g., the microphone 120*d*, because microphone M1 is closer to a large object (e.g., a wall). Large objects tend to affect the low frequency band in which the measure of radiation impedance is computed, while smaller objects remain transparent.

The acoustic orientation estimator 57 is to receive each of the measures of radiation impedance from the radiation impedance calculators 56*a*, . . . , 56*f* and to determine a direction of a nearby, acoustically reflective surface according to the principles described above in Section III. In response to the direction, the orientation estimator 57 can signal or request the audio rendering processor 51 to adjust how the input audio is rendered (according to the detected or determined direction).

The audio rendering processor 51 is to respond by adjusting the input audio signal, e.g., to direct or to re-direct a rendered sound field away from the estimated direction. For example, the audio rendering processor 51 may modify (1) spectral shape of the audio driver signal that is driving the transducer S0, and/or (2) a volume level of the audio driver signal.

For example, the audio rendering processor 51 can modify a beam pattern (by changing the driver signals to the loudspeaker array) in response to the estimated orientation. The audio rendering processor 51 can perform other signal processing operations to render the input audio signal for playback by the transducer S0 in a desired manner. In another embodiment, to determine how much to modify the driver signal, the audio rendering processor may use one or more of the impulse responses that were estimated by the adaptive filter process blocks 54*a*, . . . , 54*f*. In yet another embodiment, the audio device 50 may measure a separate impulse response of the acoustic environment, for use by the audio rendering processor 51 to modify the input audio signal.

Although indicated as an audio rendering processor, the processor 51 (or another processor to receive an input from the orientation estimator 57) can affect one or more modes of operation other than rendering audio. For example, such processor can include an image and/or video rendering processor, and/or a communication processor to communicate information over a communication connection as described more fully below in connection with computing environments.

The optional inertia sensor 59 is to sense whether the audio device 50 has been moved, and in response may signal the acoustic orientation estimator 57 to estimate an orientation of the audio device. The inertia sensor 59 may include any mechanism that senses movement of the audio device 50 (e.g., an accelerometer, a gyroscope, and/or a magnetometer that may include a digital controller which analyzes raw output data from its accelerometer sensor, gyroscope sensor or magnetometer sensor). Such a scenario may include the audio device 50 being moved from one location in a room to another (e.g., from a kitchen table to a kitchen counter), or being rotated or tilted (change in its orientation).

With such movement, sounds emitted by the transducer S0 may be experienced differently by the listener (e.g., based on changes in sound reflections). Therefore, with such a change in the acoustic environment, the input audio signal may require adjusting to maintain an optimal listening experience by the listener.

In one embodiment, upon sensing that the audio device 50 has moved, the inertia sensor generates and transmits movement data (e.g., digital information) to the acoustic orientation estimator 57 for the acoustic orientation estimator to modify the estimated orientation. In other embodiments, the acoustic orientation estimator 57 may inform the audio rendering processor 51 to adjust the driver signals based on the movement data, rather than a determination of orientation by the estimator 57. For example, in some embodiments, the movement data may be compared to a motion threshold that indicates whether the audio device 50 has been moved a great deal (e.g., moved about or changed its orientation). When the movement data exceeds or falls below a selected motion threshold, the orientation estimator 57 can initiate a new estimate, as this is an indication of a change in the acoustic environment or position of the audio device.

IX. Computing Environments

Figure 7:
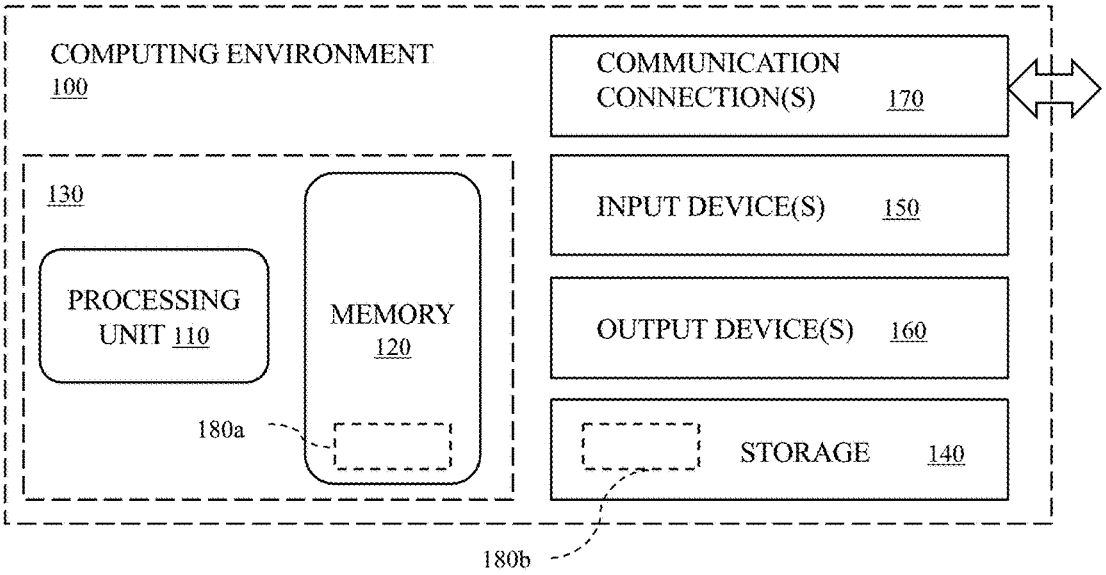
FIG. 7 shows a block diagram of a computing environment suitable for implementing disclosed methods.

FIG. 7 illustrates a generalized example of a suitable computing environment 100 in which described methods, embodiments, techniques, and technologies disclosed herein can be implemented. The computing environment 100 is not intended to suggest any limitation as to scope of use or functionality of the technologies disclosed herein, as each technology may be implemented in diverse general-purpose or special-purpose computing environments. For example, each disclosed technology may be implemented with other computer system configurations, including wearable and handheld devices (e.g., a mobile-communications device, or, more particularly but not exclusively, IPHONE®/IPAD® devices, available from Apple Inc. of Cupertino, Calif.), multiprocessor systems, microprocessor-based or programmable consumer electronics, embedded platforms, network computers, minicomputers, mainframe computers, smartphones, tablet computers, data centers, and the like. Each disclosed technology may also be practiced in distributed computing environments where tasks are performed by remote processing devices that are linked through a communications connection or network. In a distributed computing environment, program modules may be located in both local and remote memory storage devices.

The computing environment 100 includes at least one central processing unit 110 and memory 120. In FIG. 7, this most basic configuration 130 is included within a dashed line. The central processing unit 110 executes computer-executable instructions and may be a real or a virtual processor. In a multi-processing system, multiple processing units execute computer-executable instructions to increase processing power and as such, multiple processors can run simultaneously. The memory 120 may be volatile memory (e.g., registers, cache, RAM), non-volatile memory (e.g., ROM, EEPROM, flash memory, etc.), or some combination of the two. The memory 120 stores software 180*a* that can, for example, implement one or more of the innovative technologies described herein, when executed by a processor.

A computing environment may have additional features. For example, the computing environment 100 includes storage 140, one or more input devices 150, one or more output devices 160, and one or more communication connections 170. An interconnection mechanism (not shown) such as a bus, a controller, or a network, interconnects the components of the computing environment 100. Typically, operating system software (not shown) provides an operating environment for other software executing in the computing environment 100, and coordinates activities of the components of the computing environment 100.

The store 140 may be removable or non-removable, and can include selected forms of machine-readable media. In general, machine-readable media includes magnetic disks, magnetic tapes or cassettes, non-volatile solid-state memory, CD-ROMs, CD-RWs, DVDs, magnetic tape, optical data storage devices, and carrier waves, or any other machine-readable medium which can be used to store information and which can be accessed within the computing environment 100. The storage 140 stores instructions for the software 180, which can implement technologies described herein.

The store 140 can also be distributed over a network so that software instructions are stored and executed in a distributed fashion. In other embodiments, some of these operations might be performed by specific hardware components that contain hardwired logic. Those operations might alternatively be performed by any combination of programmed data processing components and fixed hardwired circuit components.

The input device(s) 150 may be a touch input device, such as a keyboard, keypad, mouse, pen, touchscreen, touch pad, or trackball, a voice input device, a scanning device, or another device, that provides input to the computing environment 100. For audio, the input device(s) 150 may include a microphone or other transducer (e.g., a sound card or similar device that accepts audio input in analog or digital form), or a computer-readable media reader that provides audio samples to the computing environment 100.

The output device(s) 160 may be a display, printer, speaker transducer, DVD-writer, or another device that provides output from the computing environment 100.

The communication connection(s) 170 enable communication over a communication medium (e.g., a connecting network) to another computing entity. The communication medium conveys information such as computer-executable instructions, compressed graphics information, processed signal information (including processed audio signals), or other data in a modulated data signal.

Thus, disclosed computing environments are suitable for performing disclosed orientation estimation and audio rendering processes as disclosed herein.

Machine-readable media are any available media that can be accessed within a computing environment 100. By way of example, and not limitation, with the computing environment 100, machine-readable media include memory 120, storage 140, communication media (not shown), and combinations of any of the above. Tangible machine-readable (or computer-readable) media exclude transitory signals.

As explained above, some disclosed principles can be embodied in a tangible, non-transitory machine-readable medium (such as microelectronic memory) having stored thereon instructions, which program one or more data processing components (generically referred to here as a "processor") to perform the digital signal processing operations described above including estimating, adapting (by the adaptive filter process blocks 54*a*, . . . , 54*f*), computing, calculating, measuring, adjusting (by the audio rendering processor 51), sensing, measuring, filtering, addition, subtraction, inversion, comparisons, and decision making (such as by the acoustic orientation estimator 57). In other embodiments, some of these operations (of a machine process) might be performed by specific electronic hardware components that contain hardwired logic (e.g., dedicated digital filter blocks). Those operations might alternatively be performed by any combination of programmed data processing components and fixed hardwired circuit components.

The audio device 10 can include a loudspeaker cabinet 12 configured to produce sound. The audio device 10 can also include a processor, and a non-transitory machine readable medium (memory) in which instructions are stored which when executed by the processor automatically perform an orientation detection process as described herein.

X. Other Embodiments

The examples described above generally concern apparatus, methods, and related systems for rendering audio, and more particularly but not exclusively, to estimating a direction of a nearby, acoustically reflective surface relative to an audio device. Nonetheless, embodiments to affect modes of operation other than those described to render audio are contemplated based on the principles disclosed herein, together with any attendant changes in configurations of the respective apparatus described herein. For example, disclosed audio devices can, in response to an estimate of a nearby surface's orientation, project a visual display toward the surface, transmit information regarding the orientation over a communication connection, e.g., to an environmental mapping system, and/or issue an alert or other user- or machine-readable information regarding an operational status of the device. As an example, disclosed audio devices can use an alert to suggest that a user reposition the audio device to improve a sound quality, or to enhance the display of a picture or video projection on to the surface.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by reference in its entirety for all purposes.

The principles described above in connection with any particular example can be combined with the principles described in connection with another example described herein. Accordingly, this detailed description shall not be construed in a limiting sense, and following a review of this disclosure, those of ordinary skill in the art will appreciate the wide variety of signal processing and audio rendering techniques that can be devised using the various concepts described herein.

Moreover, those of ordinary skill in the art will appreciate that the exemplary embodiments disclosed herein can be adapted to various configurations and/or uses without departing from the disclosed principles. Applying the principles disclosed herein, it is possible to provide a wide variety of systems embodying disclosed principles. For example, modules identified as constituting a portion of a given computational engine in the above description or in the drawings can be partitioned differently than described herein, distributed among one or more modules, or omitted altogether. As well, such modules can be implemented as a portion of a different computational engine without departing from some disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more". All structural and functional equivalents to the features and method acts of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

Thus, in view of the many possible embodiments to which the disclosed principles can be applied, we reserve to the right to claim any and all combinations of features and technologies described herein as understood by a person of ordinary skill in the art, including, for example, all that comes within the scope and spirit of the following claims.

We currently claim:

1. An audio system, comprising:

a loudspeaker cabinet having at least one loudspeaker transducer, an enclosure defining a rear chamber for the at least one loudspeaker transducer, a reference microphone transducer positioned in the rear chamber, and a microphone array having a plurality of microphones spatially distributed about and physically coupled with the cabinet; and a processor and a memory containing instructions that, when executed by the processor, cause the audio system to for each microphone, receive a corresponding audio signal, wherein the audio signal corresponding to the reference microphone comprises a reference audio signal, estimate a direction, relative to the plurality of microphones, from which a maximum acoustic energy is received by the plurality of microphones based in part on the reference audio signal and each audio signal received by the plurality of microphones; and adjust a mode of the audio system's operation responsive to the estimated direction.

2. The audio system according to claim 1, wherein the at least one loudspeaker transducer comprises a plurality of loudspeaker transducers constituting a portion of an acoustic beam former, wherein the instructions, when executed, further causes the audio system to adjust an acoustic beam emitted by the plurality of loudspeaker transducers.

3. The audio system according to claim 2, wherein the acoustic beam is directed away from the estimated direction.

4. The audio system according to claim 1, wherein the loudspeaker cabinet defines a longitudinal axis and the plurality of microphones are evenly distributed around the longitudinal axis to define a microphone beam former.

5. The audio system according to claim 4, wherein the at least one loudspeaker transducer comprises a plurality of loudspeaker transducers evenly distributed around the longitudinal axis to define a loudspeaker beam former.

6. The audio system according to claim 1, wherein the audio system comprises a plurality of other loudspeaker transducers, wherein the instructions, when executed by the processor, cause the audio system to adjust the mode of the audio system's operation by adjusting a drive signal output to one or more of the plurality of other loudspeaker transducers.

7. The audio system according to claim 6, wherein the instructions, when executed by the processor, cause the audio system to render, with the plurality of other loudspeaker transducers, a selected acoustic beam pattern relative to the estimated direction.

8. The audio system according to claim 6, wherein the instructions, when executed by the processor, cause the audio system to modify one or both of a spectral shape and a volume level of the respective drive signal output.

9. The audio system according to claim 1, wherein the instructions, when executed by the processor, cause the audio system to estimate the direction, relative to the plurality of microphones, from which the maximum acoustic energy is received by the plurality of microphones during playback of a media content.

10. The audio system according to claim 1, wherein the instructions, when executed by the processor, cause the audio system to adjust an acoustic beam pattern rendered by the audio system during playback of the media content based on the adjusted mode.

11. The audio system according to claim 1, further comprising an inertial sensor, wherein the memory contains further instructions that, when executed by the processor, cause the audio system to estimate the direction responsive to an output from the inertial sensor.

12. The audio system according to claim 1, further comprising a communication connection, and wherein the memory contains further instructions that, when executed by the processor, cause the audio system to communicate the estimated direction over the communication connection.

13. The audio system according to claim 1, wherein the memory contains further instructions that, when executed by the processor, cause the audio system to issue an alert or other user- or machine-readable information responsive to the audio signal received by one or more of the microphones.

14. The audio system according to claim 1, wherein the instructions, when executed by the processor, cause the audio system to tailor the audio system's output to a listening environment.

15. An audio system, comprising:

a loudspeaker cabinet having at least one loudspeaker transducer and a microphone array having a plurality of microphones spatially distributed about and physically coupled with the cabinet; and a processor and a memory containing instructions that, when executed by the processor, cause the audio system to for each microphone, receive a corresponding audio signal estimate a direction, relative to the plurality of microphones, from which a maximum acoustic energy is received by the plurality of microphones based in part on each received audio signal, adjust a media playback and to estimate the direction in real time with the media playback, and affect a mode of the audio system's operation responsive to the estimated direction.

16. A method for affecting a mode of operation of a device, the method comprising:

emitting an acoustic output from a loudspeaker cabinet comprising a plurality of loudspeaker transducers and a plurality of microphones, wherein the cabinet defines a longitudinal axis and the loudspeaker transducers are distributed around the longitudinal axis to define a beam forming array of loudspeakers, wherein the act of emitting the acoustic output comprises reproducing an audio content;

with each microphone, receiving an audio signal corresponding to the respective microphone;

based at least in part on the plurality of received audio signals, estimating a direction of an acoustically reflective surface relative to the plurality of microphones; and modify a mode of operation of the device responsive to the estimated direction by reproducing the audio content with the loudspeaker beam forming array and directing the reproduced audio content in a direction away from the estimated direction.

17. The method according to claim 16, wherein the emitted acoustic output comprises an acoustic beam emitted by the plurality of loudspeaker transducers.

18. The method according to claim 17, wherein the act of modifying a mode of operation comprises one or more of directing the acoustic beam away from the estimated direction, directing a projected image or video toward the estimated direction, informing a mapping process, and communicating the estimated direction or an associated information over a communication connection.

19. The method according to claim 16, wherein the at least one loudspeaker transducer comprises a plurality of loudspeaker transducers and the loudspeaker cabinet comprises an enclosure defining a rear chamber for one in the plurality of loudspeaker transducers, wherein the plurality of microphones comprises a reference microphone positioned in the rear chamber to receive a reference audio signal, wherein the act of estimating the direction comprises estimating the direction based in part on a comparison of each respective audio signal received by each other microphone relative to the reference audio signal received by the reference microphone.

20. The method according to claim 19, wherein the act of estimating the direction further comprises estimating a magnitude of a transfer function between each respective audio signal received by each of the other microphones and the reference audio signal received by the reference microphone.

21. The method according to claim 20, wherein the act of estimating the direction comprises the act of determining a phase of the first-order mode of a Fourier decomposition of a sequence of the transfer-function magnitudes, the act of determining a variation of the transfer-function magnitude with microphone position relative to the loudspeaker cabinet, or both.

22. The method according to claim 16, wherein act of modifying a mode of operation of the device further comprises adjusting a drive signal output to one or more of the plurality of loudspeaker transducers.

23. The method according to claim 16, wherein the act of reproducing the audio content with the loudspeaker beam forming array and directing the reproduced audio content in a direction away from the estimated direction comprises rendering, with the plurality of loudspeaker transducers, a selected acoustic beam pattern relative to the estimated direction.

24. The method according to claim 16, wherein the act of estimating the direction of the acoustically reflective surface relative to the plurality of microphones occurs during the act of reproducing the audio content.

25. The method according to claim 16, wherein the act of modifying the mode of operation of the device occurs during the act of reproducing the audio content.

26. The method according to claim 16, wherein the loudspeaker cabinet further comprises an inertial sensor, wherein the act of estimating the direction of an acoustically reflective surface relative to the plurality of microphones is based at least in further part on an output from the inertial sensor.

27. An article of manufacture, comprising a tangible, non-transitory computer readable media containing instructions, that, when executed by a processor of a device having a loudspeaker cabinet defining a longitudinal axis, a plurality of loudspeaker transducers spatially distributed about the longitudinal axis to define a loudspeaker array for beam forming audio, and a microphone array for beam forming, the microphone array having a plurality of microphones spatially distributed about and physically coupled with the device, cause the device to receive a respective acoustic signal at each microphone, in real time with beam forming audio, estimate a direction, relative to the plurality of microphones, of an acoustically reflective surface based in part on each received acoustic signal; and beam form the audio in a direction opposite the estimated direction.

* * * * *